US005745038A

United States Patent [19]

Vance

[11] Patent Number: 5,745,038

[45] Date of Patent: Apr. 28, 1998

[54] AWAKENING ALARM FOR MOTOR VEHICLE OPERATORS

[76] Inventor: David L. Vance, 112 E. 23rd St. Apt. 22, Roswell, N. Mex. 88201

[21] Appl. No.: 822,213

[22] Filed: Mar. 21, 1997

[51] Int. Cl.[6] ..... G08B 21/00

[52] U.S. Cl. ..... 340/575; 340/576

[58] Field of Search ..... 340/575, 576, 340/573

[56] References Cited

U.S. PATENT DOCUMENTS

| | | | |
|---|---|---|---|
| 2,724,109 | 11/1955 | Skolnick et al. | 340/575 |
| 2,726,380 | 12/1955 | Campisi | 340/575 |
| 4,144,531 | 3/1979 | Anbergen | 340/576 |
| 5,402,109 | 3/1995 | Mannik | 340/575 |
| 5,469,143 | 11/1995 | Cooper | 340/575 |

OTHER PUBLICATIONS

"Road and Track" Apr. 1995 Hey! Wake up! p. 180.

"Discover" Jul. 1996 Awake at the Wheel p. 60.

*Primary Examiner*—Glen Swann

[57] ABSTRACT

Eyeglasses hold a light sensor (1) positioned to receive light reflected from an eye. An electronic comparator circuit (4) uses variations of current through the sensor which occur during blinking and eye movement to produce pulses which reset an electronic timing cycle, thereby continually delaying the activation of an alarm signal (8). In the absence of eye motion for a predetermined period of time a warning tone is sounded in the preferred embodiment, followed by a full volume alarm if needed to wake a sleeping driver.

4 Claims, 4 Drawing Sheets

AWAKENING ALARM FOR MOTOR VEHICLE OPERATORS

BACKGROUND OF THE INVENTION

The present invention relates to motor vehicle safety devices and specifically to a practical and reliable device which responds to indications of driver fatigue by sounding an alarm.

Driver fatigue, resulting in inattention and falling asleep at the wheel, is considered responsible for many highway accidents. Early signs of fatigue include staring blankly at the road ahead and a reduction in the rate of blinking as drivers struggle to keep their eyes open; a condition sometimes known as "highway hypnosis". Drivers of motor vehicles, particularly on long highway drives, are frequently stricken by fatigue and need to stop and rest in order to return to an alert condition before continuing. The driver, however, may be miles from a safe area in which to stop and is therefore required to continue driving. It is therefore a primary object of the present invention to provide an aid for motor vehicle operators to maintain a condition of alertness until a safe rest area is available.

Prior art in the area of awakening alarms for drivers has included devices to sense such indications of sleep as nodding of the head or erratic steering wheel movements. Devices depending on such indications have been found to trigger an alarm too late to be of use in preventing accidents.

Devices intended to be installed as part of a vehicle and to operate at a distance from the driver are necessarily complex and expensive. Further, such devises are likely to be available only in new vehicles, so not for use by the general public in the near future.

Prior art inventions using glasses as part of a system to detect a sleeping driver and to provide an awakening alarm have, in general, attempted to use the closing of the eyes to activate an alarm signal. Such devises sometimes include a timer to provide a delay period between the closing of the eyes and the activation of the alarm and can be thought of as having a positively triggered alarm since the timing cycle begins when the eyes are closed. The present invention differs from prior art in that blinking and eye motion, which are characteristic of an alert driver, are used to continually delay the activation of an alarm signal. Advantages of the system of the present invention will be seen in the following specifications.

Certain prior inventions have proposed using the eyelash or eyelid when the eye is closed to interrupt a beam between a light source and light sensor, thereby triggering an alarm. A break-beam device such as U.S. Pat. No. 5,402,109 to Mannick (1995) requires elaborate means to maintain an uncommonly precise relation of a source and sensor to the eye, making the glasses of this device inconvenient to use and uncomfortable to wear.

A device such as U.S. Pat. No. 5,469,143 to Cooper (1995) which has an element in physical contact with the eyelid has an additional disadvantage in the discomfort that is experienced when anything touches the sensitive area surrounding the eye.

To use the difference in the amount of light reflected by the open eye and by the eyelid to positively trigger an alarm signal when the eye is closed requires a complex electronic circuit to eliminate the effect of changes in ambient light or changes which occur when the head is moved. Further, since different areas of an open eye reflect light differently, certain kinds of eye movement may cause false alarms. Further still, a positively triggered alarm relying on a change in the amount of light received by a sensor while compensating for changes in ambient light will require a relatively sudden closing of the eye to function properly and may not trigger an alarm in response to drooping eyelids and the gradual closing of the eye.

A further disadvantage of all such prior art devices which rely entirely on the closing of an eye to trigger an alarm is that closed eyes indicate the condition of sleep and that the driver has already lost attention and control. The alarm, then, may be triggered too late to prevent an accident.

OBJECTS OF THE INVENTION

Accordingly, an object of the invention is to provide an awakening alarm which is reliable and capable of responding to early signs of driver fatigue.

Another object of the invention is to provide an awakening alarm which is easy to use and comfortable to wear.

Another object of the invention is to provide an awakening alarm which is simple and inexpensive.

Another object of the invention is to provide an awakening alarm which is portable and may be used in any vehicle.

SUMMARY OF THE INVENTION

The present invention comprises eyewear in the form of glasses as a convenient means of holding a light sensor in position to receive light reflected from an eye and to be affected by a difference in reflectivity of the eyelid and the surface of the open eye. This sensor provides input to an electronic circuit wherein an integrated circuit comparator uses variations in voltage which occur during blinking and certain kinds of eye movement to produce pulses which reset an electronic timing cycle, thereby delaying the activation of an alarm signal. Drooping eyelids, staring without blinking and closed eyes are conditions which produce a steady input state through the sensor and which will allow the timing cycle to be completed, activating an alarm. In this way the present invention is able to respond both to signs of sleep and to early signs of fatigue. In a preferred embodiment a two-stage timing cycle is provided so that a muted warning tone may first be sounded as a reminder to the wearer of the glasses either to open the eyes or to blink and shift the point of vision. A full alarm is sounded at the completion of a second short-duration timing cycle if the wearer of the glasses fails to respond to the warning tone. This feature makes an alarm of this type less objectionable to use, therefore more likely to be used to encourage frequent eye movement; an often cited counter-measure against the effects of fatigue.

Overcoming prior art disadvantages, the present invention provides a simple electronic circuit which uses ambient light except in low-light or night conditions when an infrared source is required for illumination. Change in the amount of ambient light and changes which occur when the head is moved have little effect on the functioning of the present invention. Further, since an alarm is triggered by a reliable timing device in response to an absence of blinking or eye movement, false alarms and missed alarms are effectively eliminated. The ability of the circuit of the present invention to use reflected light also allows the location of both a sensor and an infrared source in the center, nose-pad area of a pair of glasses, providing for unrestricted vision and permitting some shifting of the glasses on the face to occur while maintaining the necessary alignment of sensor to the eye.

DETAILED DESCRIPTION OF THE PREFERRED EMBODIMENT

Figure 1:
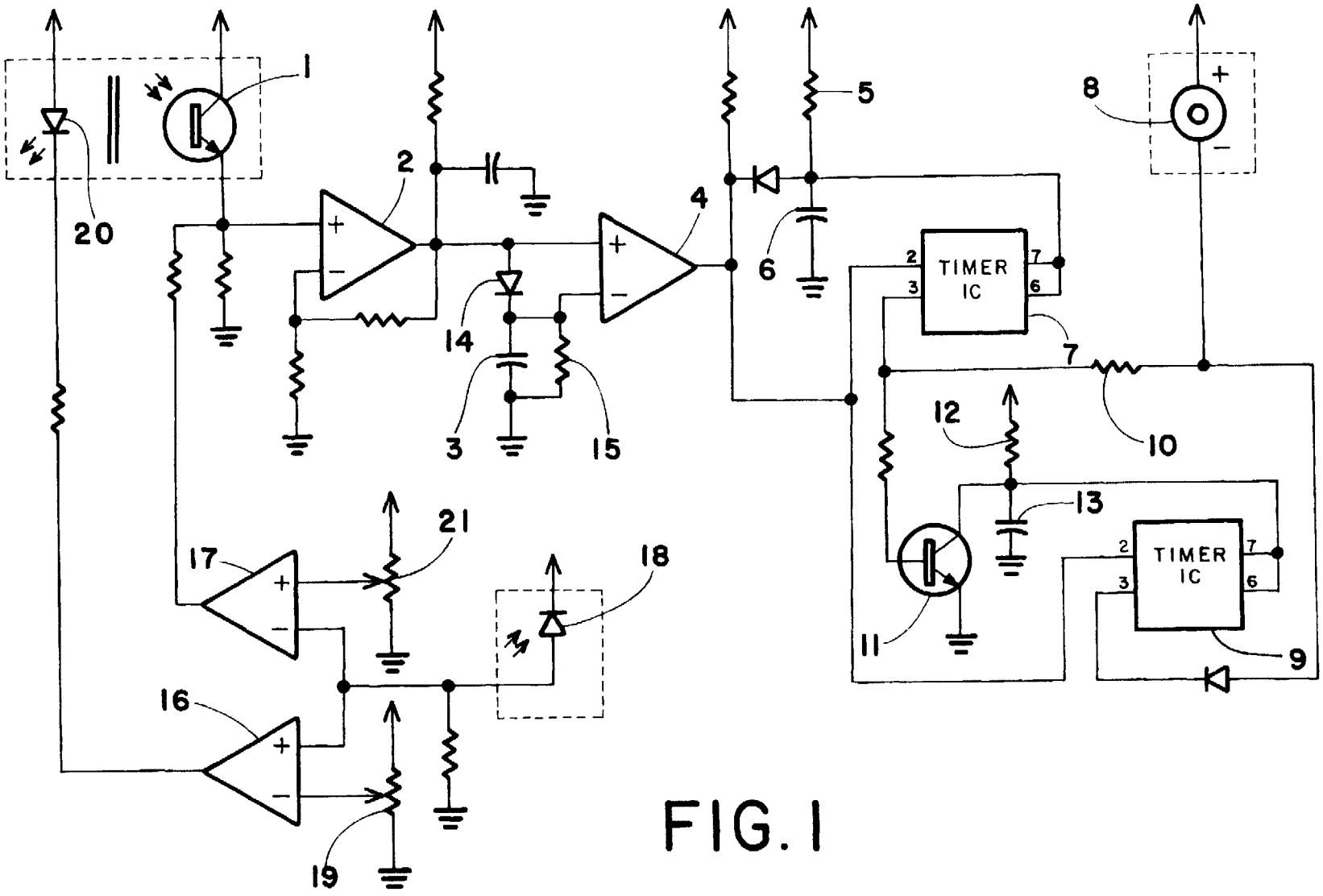
FIG. 1 is a schematic diagram of an electronic circuit according to the preferred embodiment.

FIG.1 shows a schematic diagram of an electronic circuit according to the preferred embodiment. The circuit shown is based upon a multiple comparator integrated circuit such as the 339 series comparator, chosen for the characteristics of operation over a wide voltage range and single polarity power supply requirements. Combinations of other components, however, which function in essentially the same way and with the same result should be considered as within the scope of the present invention. Light sensor 1 is positioned and shielded to receive light which is reflected from an eye and provides input for the following circuit. Comparator 2 is shown used in a feedback loop circuit and functions as a voltage amplifier. The primary function of this stage is to supply sufficient current to charge capacitor 3. Typically, when a silicon phototransistor as shown provides input, the output of comparator 2 may follow input voltage or provide low-gain amplification if necessary. Comparator 4 is used in open loop mode. When voltage at the inverting input exceeds voltage at the non-inverting input, the output of comparator 4 will switch to ground.

The values of resistor 5 and capacitor 6 define the duration of a timing cycle for a 555 or similar type timer integrated circuit 7. Beginning operation, capacitor 6 is being charged through resistor 5. If the charge on capacitor 6 is allowed to reach the threshold voltage of timer 7 the output of this timer will switch to ground, activating alarm signal 8. In the preferred embodiment a second timer 9 may be used in cascaded relation to timer 7 such that when signal 8 is activated to a muted warning tone through resistor 10, NPN transistor 11 is simultaneously made non-conductive, beginning a short-duration timing cycle defined by the values of resistor 12 and capacitor 13, after which alarm signal 8 will be activated to full output.

In the act of blinking, the eye is first closed and light sensor 1 is exposed to an increased intensity of light from the generally more reflective eyelid. Current through sensor 1 increases and capacitor 3 is charged to a higher voltage level through diode 14. Completing the act of blinking, the eye is reopened and light sensor 1 is exposed to a decreased intensity of light from the less reflective surface of the eye. Voltage at the non-inverting input to comparator 4 decreases while the charge on capacitor 3 and, therefore, voltage at the inverting input to comparator 4 remains at a higher level for a period of time dependent on the values of capacitor 3 and resistor 15. Upon the opening of the eye, then, voltage at the inverting input is made to exceed voltage at the non-inverting input and the output of comparator 4 switches to ground, discharging capacitor 6; thereby resetting the timing cycle of timer 7. At the same time a trigger pulse is delivered to both timers, allowing a new timing cycle to begin when the output of comparator 4 switches from ground due to discharge of capacitor 3 through resistor 15.

The act of looking down, as when a driver checks the speedometer, followed by returning vision to the road, will have the same effect as blinking. Further, when a light sensor is positioned as shown in the drawings, shifting the eyes to the left, as when checking the drivers outside rearview mirror, will bring the light absorbing pupil of the eye into the area monitored by the sensor and may serve to further delay the sounding of an alarm. In this way an alarm may be continually delayed only by the frequent eye movement of an alert driver, while absence of eye movement, indicating sleep or fatigue, will allow the alarm of the present invention to be activated. For the task of driving a motor vehicle the duration of the initial timing cycle should be in the range of a few seconds. By providing a longer initial timing cycle, however, the device of the present invention can be made more useful for tasks which require that a user stay awake for a period of time but which do not require the moment by moment attention of driving. Such tasks might include piloting of aircraft or watercraft and security watches.

Comparators 16 and 17 are shown used in a system allowing the present invention to operate under the widely varying lighting conditions encountered by a motor vehicle operator.

Operating from input provided by a light sensor 18, positioned so as to be affected only by changes in ambient light, comparator 16 is adjustable by means of variable resistor 19 to activate infrared-emitting diode 20 when the light level falls below circuit requirements. Comparator 17 is adjustable by means of variable resistor 21 to reduce input balance resistance under the extreme lighting condition encountered when driving into a morning or evening sun. Comparators may be used in a similar way to control current through infrared-emitting diode 20 or to modify amplifier gain. By the addition of comparators a further multiplicity of overlapping ranges can be provided if desired.

Figure 2:
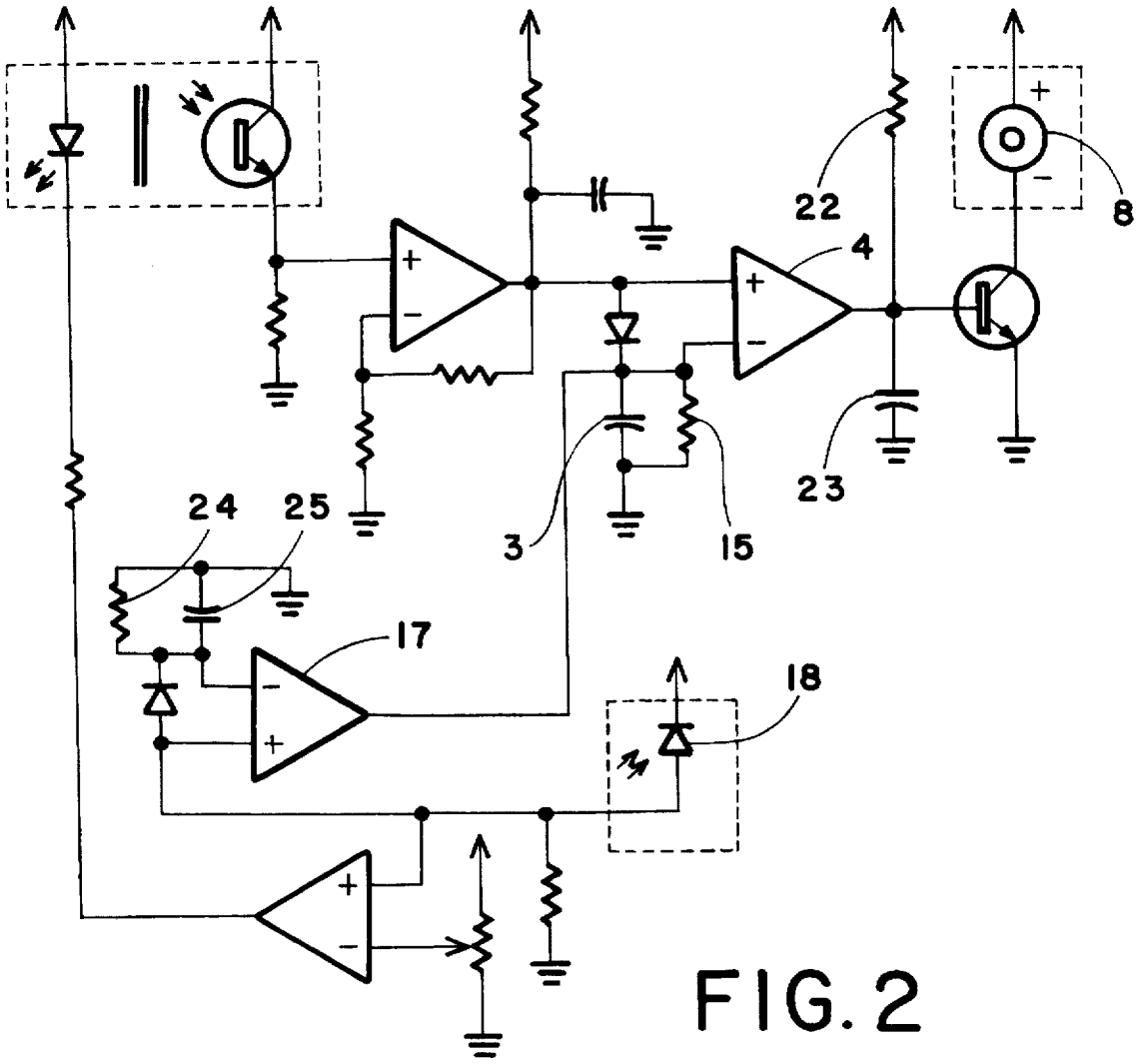
FIG. 2 is a schematic diagram of an abbreviated circuit.

FIG.2 shows an abbreviated circuit according to the present invention which will sound an alarm when the eyes are closed for a period of time longer than that which is required for blinking. The values of capacitor 3 and resistor 15 are chosen to allow at least several seconds after blinking before the output of comparator 4 switches to positive voltage due to current flow through resistor 15. The circuit of capacitor 3 and resistor 15, then, functions as a timer. Resistor 22 and capacitor 23 provide a delay long enough to allow blinking to occur without sounding alarm signal 8. Comparator 17 is shown having an input circuit which functions the same as that for comparator 4. Values of resistor 24 and capacitor 25 are chosen to provide a momentary short of capacitor 3 to ground when a sharp decrease in light intensity is experienced at sensor 18 such as would occur immediately after the lights from an oncoming vehicle have shone in the eyes of a driver, since such an occurrence might otherwise temporarily disable the alarm. Since a circuit of the type shown in FIG.2 will more closely monitor the open or closed condition of the eye, an emergency mode of operation could be so provided for a circuit according to the preferred embodiment, selectable by means of a two-position switch, if a driver feels in immediate danger of falling asleep.

Figure 3:
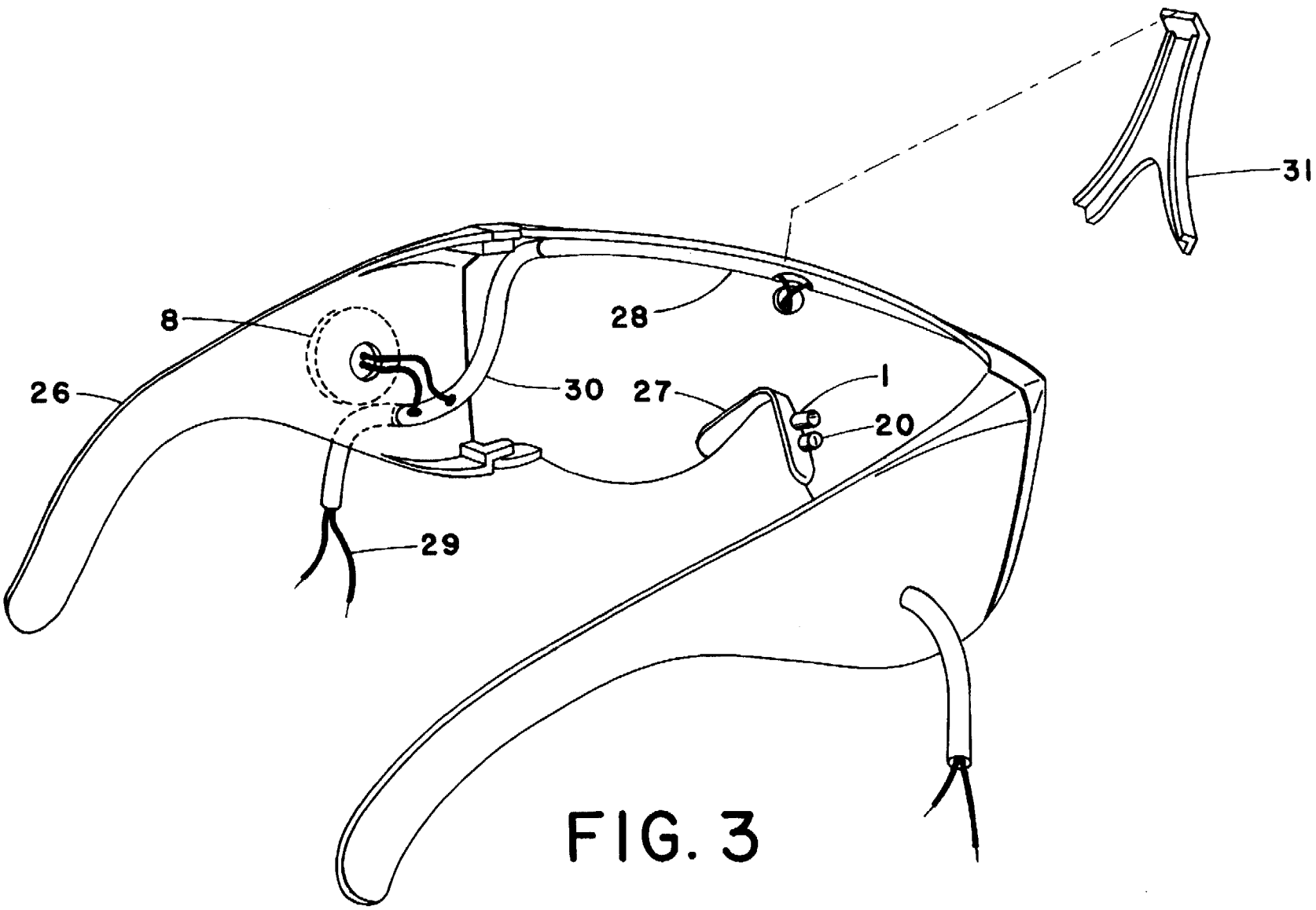
FIG. 3 is a rear view showing details for construction of eyewear according to the present invention.

FIG.3 shows one method for constructing eyewear according to the present invention. Glasses of a type made of molded plastic and having hinged, molded ear-pieces 26 and integral, molded nose-pads 27 hold shielded light sensor 1 and infrared diode 20. A conduit 28 for electrical leads 29 extends along the upper edge of the glasses to a flexible conduit 30 running through and held by ear-piece 26. An opaque front cover 31 provides clearance for electrical leads and connections to light sensor 1 and infrared diode 20. One possible location for alarm signal 8, shown here as a piezo buzzer element, is mounted to ear-piece 26. Alternately, if a signaling means is provided in the form of an earphone of the type which can be worn in the ear, a strong alarm tone can easily be provided which is audible only to the wearer of the glasses.

Figure 4:
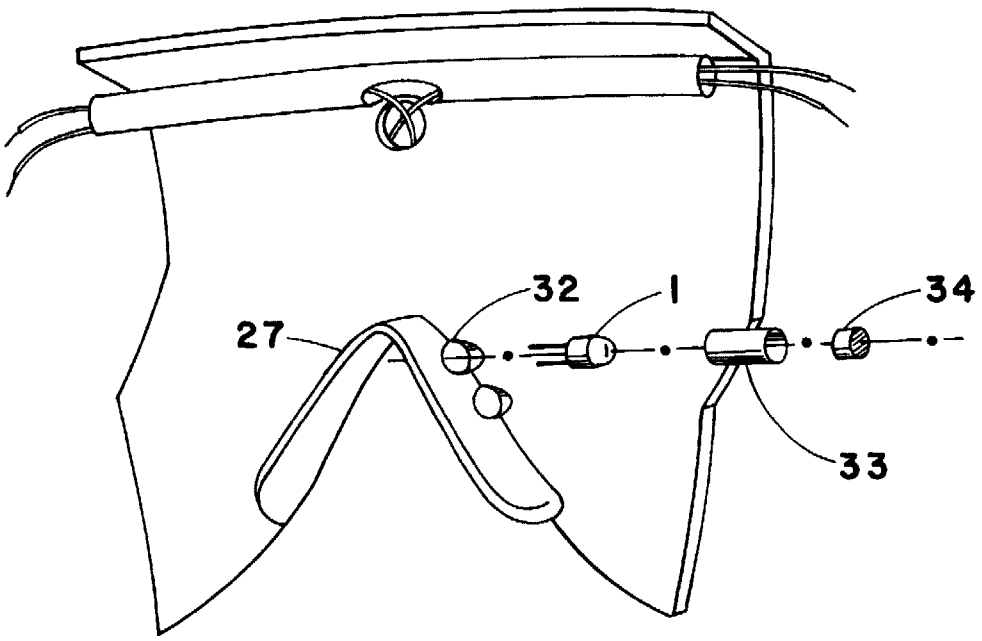
FIG.4 is an exploded view of light sensor and shield in relation to nose-pad section of glasses.

FIG.4 illustrates, in exploded view, the relation of nose-pad 27 to a hole 32, angled to hold light sensor 1 and tubular light shield 33 directed toward a wearer's right eye. Location of a sensor in this area of a pair of glasses allows close proximity of the sensor to the eye yet provides an un-diminished field of vision. Alternately, light guides or fiber-optic material could be used to facilitate the location of a sensor or infrared source in another area of a pair of glasses according to the present invention. A feature allowing the distance between separate nose-pads extending from glasses to be widened or narrowed, such as is commonly incorporated into many designs for eyewear, would permit the height of the glasses upon the nose to be adjusted for individual users of the present invention; thus providing for optimum positioning of a sensor at or somewhat below the vertical center of the eye. Certain very sensitive photo-electrical devises may require the use of a light-reducing aperture or filter element 34 to assure that the device operates below the level of electrical saturation.

Figure 5:
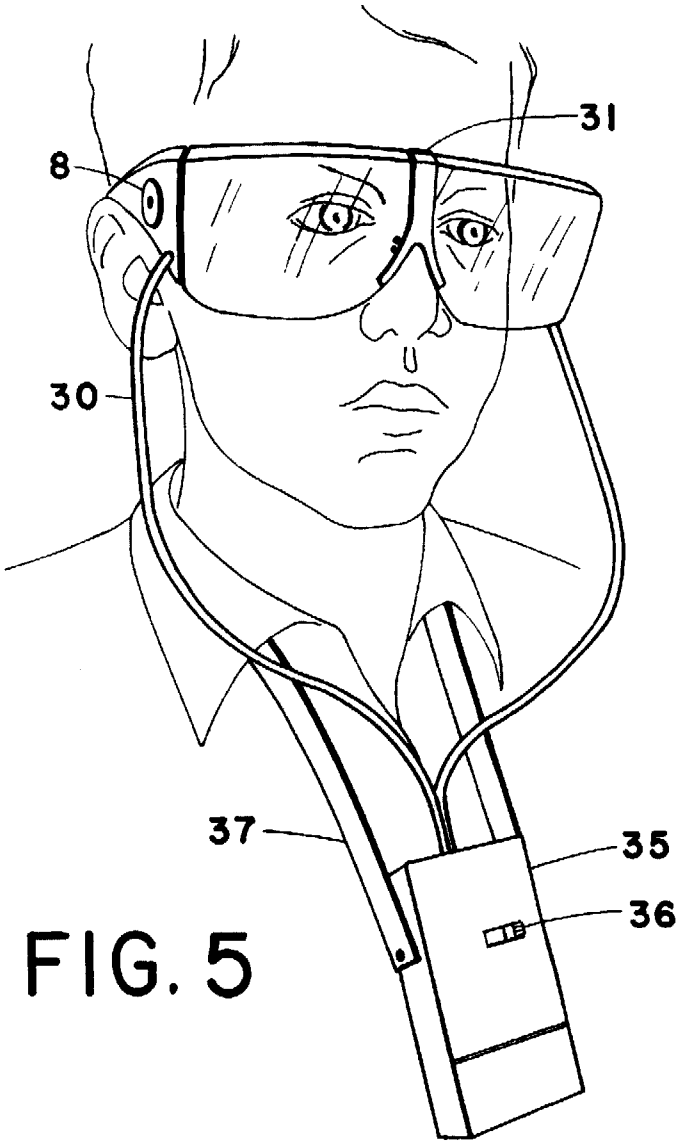
FIG.5 shows glasses worn with circuit enclosure.

In FIG.5 covered electrical leads 30 are shown extending to an enclosure 35 for an electronic circuit according to the present invention made with currently standard size components and including a battery power supply and a power switch 36. A neck-strap 37 is shown as one means of supporting enclosure 35. The use of currently available miniature electronic components would offer the advantage of reduced circuit size and weight and the possibility of including a circuit within the frame area of eyewear according to the present invention, eliminating the need for a separate circuit enclosure.

Although one method for constructing glasses has been detailed in the drawings, many modifications are possible in construction. Provision of suitable electrical contacts to the contacting surfaces of the frame section of glasses and the hinged ear-pieces such that electrical contact is made when the glasses are unfolded would allow continuation of electrical leads when the glasses are worn while allowing glasses to be folded without the bending of conductors. Designs providing for interchangeable lenses for day or night-time use or allowing prescription lenses to be used would further the usefulness of the present invention. The use of photochromic material in lenses could provide a degree of passive control of the amount of light reaching the sensor, while the use of liquid crystal material in a filter element could provide further electronic control of light. Electrical leads within the glasses could be provided in the form of conductive material printed on or incorporated into the material of the glasses during manufacture. By using timer output to activate relays, a powerful remote alarm could be controlled; perhaps most useful if an embodiment of the present invention were powered from a cigarette lighter outlet. Therefore, it should be understood from the preceding specifications and drawings that variations in construction and use are possible within the spirit and scope of the present invention according to the appended claims.

Having described my invention in sufficient detail to enable those skilled in the art to make and use it, I claim:

1. A method for producing a signal in response to signs of fatigue or sleep in an individual comprising the steps of providing a signaling means, providing a timing means to activate said signaling means after a delay, providing a light sensitive element influenced by eye activity, and providing means to reset said timing means in response to eye activity wherein a present input level from said light sensitive element is compared to a preceding level from the same to determine significant variation.

2. An awakening alarm device comprising a signaling means, a timing means to activate said signaling means after a delay, means to reset said timing means comprising a light sensitive element and a voltage comparator circuit having a first input provided with a present input voltage from said element and having a second input provided with a voltage representing a preceding input level, and wearable means to position said light sensitive element to receive light influenced by eye activity.

3. The device of claim 2 which further comprises means to activate said signaling means to an increased level of output after a secondary delay.

4. The device of claim 2 which further comprises an eye illuminating means and means to activate said illuminating means responsive to ambient light level.

* * * * *